US011026513B2

(12) United States Patent
Bates

(10) Patent No.: US 11,026,513 B2
(45) Date of Patent: Jun. 8, 2021

(54) CUSHION

(71) Applicant: MelloBe LLC, Boerne, TX (US)

(72) Inventor: Julia Bates, San Antonio, TX (US)

(73) Assignee: MelloBe LLC, San Antonio, TX (US)

( * ) Notice: Subject to any disclaimer, the term of this patent is extended or adjusted under 35 U.S.C. 154(b) by 0 days.

(21) Appl. No.: 16/558,103

(22) Filed: Aug. 31, 2019

(65) Prior Publication Data

US 2020/0069063 A1 Mar. 5, 2020

Related U.S. Application Data

(60) Provisional application No. 62/725,576, filed on Aug. 31, 2018.

(51) Int. Cl.

| | |
|---|---|
| ***A47G 9/10*** | (2006.01) |
| ***A47C 7/02*** | (2006.01) |
| ***A47C 3/16*** | (2006.01) |
| ***A47C 5/12*** | (2006.01) |

(52) U.S. Cl.

CPC ..... *A47C 7/029* (2018.08); *A47C 3/16* (2013.01); *A47C 5/125* (2013.01); *A47G 2009/1018* (2013.01)

(58) Field of Classification Search

CPC ..... A47C 7/021; A47C 7/0213; A47C 7/029; A47C 3/16; A47C 5/14; A47C 1/16; A61G 5/1045

USPC ..... 297/452.21, 452.25, 452.26, 452.27, 297/219.11, 219.12, 219.1

See application file for complete search history.

(56) References Cited

U.S. PATENT DOCUMENTS

| | | | | |
|---|---|---|---|---|
| 3,648,308 | A * | 3/1972 | Greenawalt | A47G 9/1081 5/632 |
| 5,026,585 | A * | 6/1991 | Funatogawa | A47C 9/005 428/71 |
| 2003/0101514 | A1* | 6/2003 | Roberson | A47C 16/04 5/632 |
| 2006/0012227 | A1* | 1/2006 | Obermaier | A47C 7/029 297/219.1 |
| 2006/0037143 | A1* | 2/2006 | Green | A47C 15/004 5/653 |
| 2006/0272582 | A1* | 12/2006 | Dunn | A01K 1/0353 119/28.5 |
| 2008/0061618 | A1* | 3/2008 | DeSimone Lavigne | A47C 3/16 297/452.21 |
| 2008/0164745 | A1* | 7/2008 | Nichols | A47C 3/16 297/452.48 |
| 2013/0291306 | A1* | 11/2013 | Willingham | A47G 9/109 5/636 |
| 2016/0000242 | A1* | 1/2016 | Campagna | A61G 13/122 5/632 |
| 2016/0106061 | A1* | 4/2016 | Nelson | A01K 1/0353 119/28.5 |

(Continued)

*Primary Examiner* — Kyle J. Walraed-Sullivan

(74) *Attorney, Agent, or Firm* — Shah IP Law, PLLC

(57) ABSTRACT

An apparatus for improving blood flow in a user's leg and improving posture is disclosed herein. The apparatus is a portable seating cushion that a user may sit upon, which improves blood flow by reducing point-pressure that may otherwise be applied to nerves and blood vessels in a user's leg, including the sciatic nerve. Moreover, the portable seating cushion improves posture by creating a forward pelvic tilt, which causes the rest of the user's shoulders, spine, back, and neck to come into alignment when the user sits on the cushion.

14 Claims, 10 Drawing Sheets

(56) References Cited

U.S. PATENT DOCUMENTS

2016/0255961 A1* 9/2016 Harte ..... A47C 7/029
2019/0029218 A1* 1/2019 Komatsubara ..... A01K 1/0353

* cited by examiner

CUSHION

CROSS-REFERENCE TO RELATED APPLICATIONS

This application claims priority to U.S. Provisional Patent Application Ser. No. 62/725,576, filed Aug. 31, 2018 entitled "Meditation Cushion." The entire content of that application is incorporated herein by reference.

BACKGROUND

Field of the Art

This disclosure relates to a portable seating cushion apparatus that a user may sit upon. The portable seating apparatus can be placed on variety of surfaces and is designed to improve users' blood flow and posture regardless of the users' seating position.

Discussion of the State of the Art

A common complaint about sitting for long periods of time is the discomfort individuals experience during prolonged sessions of being seated, especially when seated in a lotus position with legs crossed or in chairs. When individuals are seated in these positions, their nerves and blood vessels become constricted, and as a result, blood flow is reduced. This can cause numbness and painful tingling sensations in the legs, back, and upper extremities.

In addition to the pain caused by changes in blood flow and the compression of nerves and blood vessels, individuals who remain in a seated position for an extended period of time often also complain about pain in their back, neck, shoulders, and pelvis. This pain is caused by spinal misalignment, which is typically associated with a poor sitting posture. Generally, when individuals sit down, their pelvis tilts backwards, which causes their spine to become misaligned, and leads to discomfort and pain related to poor posture.

SUMMARY

The inventor has conceived and reduced to practice a portable seating cushion apparatus for improving blood flow by reducing point-pressure that may otherwise be applied to nerves and blood vessels in a user's leg, including the sciatic nerve, and improving posture by creating a forward pelvic tilt, which causes the rest of the user's shoulders, spine, back, and neck to come into alignment.

A feature of the present invention is that it is uniquely shaped. The crescent shape of the present inventive apparatus supports a substantial portion of the user's upper leg, thereby distributing the weight of the user's body throughout the user's buttocks and upper legs. This inventive feature allows for the reduction of pressure at one or more specified points in the user's legs which otherwise may be caused by cushions that abruptly end at or near the user's buttocks.

Another feature of the present invention is that it is specifically inclined to tilt the user's pelvis forward to ensure a neutral seated position. A slight forward pelvic tilt can cause the user's hip flexors to open, which can promote proper posture by aligning the spine, back, shoulder, neck and head of the user. Additionally, by promoting a neutral seated position, the incline of the sitting surface offers stability and support to the user and may decrease physical discomfort and promote proper circulation.

Another feature of the present invention is that it includes distinctive combined materials, which when combined, compress to maintain a gradual incline when a user is sits on the cushion. In addition, the material disclosed allows for subtle shifts under a user's weight. By shifting slightly, the inventive apparatus allows for a contoured sitting surface that uniquely contours to each user. Generally, the aforementioned crescent shape in combination with the incline and materials of the inventive apparatus, reduce pressure on the user's sciatic nerve that would otherwise occur in the seated position.

More specifically, the present invention, in accordance with an embodiment, is for a portable seating cushion comprising a foam element having a gradually inclined first surface and a substantially planar second surface, the first and second surfaces defining therebetween a volume of gradually changing thickness, a dispersion bag enclosing dispersion elements within an interior cavity of the dispersion bag, the dispersion elements providing greater resistance to compressive forces than the foam element, and an exterior enclosure enclosing the dispersion bag and the foam element within the interior cavity of the exterior enclosure, the exterior enclosure having a sitting surface and a bottom surface, wherein the dispersion bag is placed above the foam element when the sitting surface of the exterior enclosure is above the bottom surface, and wherein the combination of the foam element and the dispersion bag impart a gradually inclined sitting surface.

In one embodiment, the cushion further comprises two leg support extension elements extending from a portion of the cushion, wherein the leg support extension elements supporting the upper thighs of a user who may be sitting on the cushion. The two leg support extension elements may be tapered to minimize the amount of point pressure that may be applied by the cushion to the upper thighs of a user who may be sitting on the cushion. The foam element of the invention may be further comprised of two leg support extension foam elements, the leg support extension foam elements each having a gradually inclined first surface and a substantially planar second surface. The dispersion bag of the invention may be further comprised of two leg support extension elements.

The exterior enclosure of the present invention is further comprised of an opening for inserting or removing the foam element and/or the dispersion element from the interior cavity of the exterior enclosure.

In one embodiment, the foam element and dispersion elements compress under pressure to provide a stable sitting surface for a user. However, the foam element compresses more than the dispersion elements when weight of a user is placed on the cushion. In one embodiment, the dispersion elements may move about within the interior cavity of the dispersion bag. Moreover, the movement of the dispersion elements that is caused by the weight of a user creates a slightly contoured sitting surface for the user. In one embodiment, the dispersion elements may be comprised of buckwheat hulls. The dispersion elements may also conduct less heat than the foam element to ensure that the sitting surface of the cushion remains cool and comfortable during use.

The cushion may be further comprised of a connection element for connecting the foam element to the dispersion bag. In accordance with an embodiment of the invention, the connected dispersion elements and the foam element form a gradually inclined sitting surface. The gradually inclined sitting surface of the exterior enclosure provides pelvic lift to a user who sits on the cushion. Moreover, the gradually inclined sitting surface of the exterior enclosure promotes spinal alignment of the spine of a user who sits on the cushion.

BRIEF DESCRIPTION OF THE DRAWING FIGURES

The accompanying drawings illustrate several embodiments and, together with the description, serve to explain the principles of the invention according to the embodiments. It will be appreciated by one skilled in the art that the particular arrangements illustrated in the drawings are merely exemplary and are not to be considered as limiting of the scope of the invention or the claims herein in any way.

DETAILED DESCRIPTION

Figure 1:
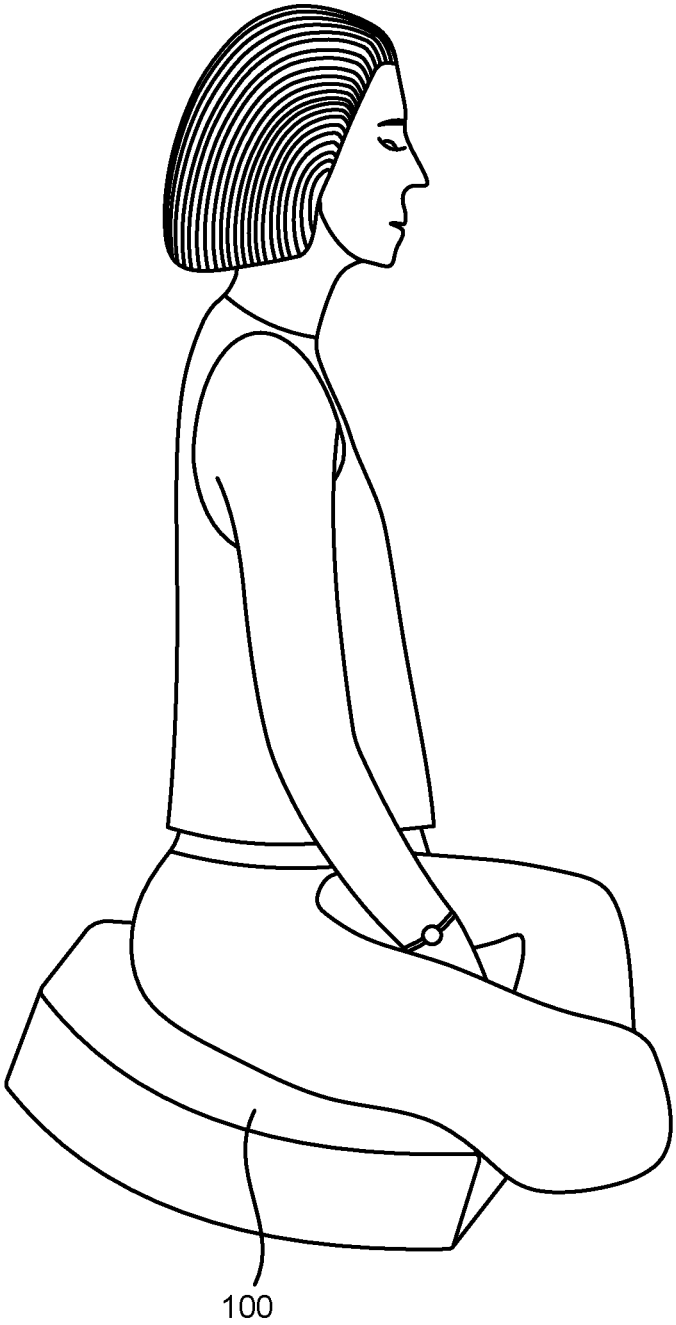
FIG. 1 illustrates a user sitting on an exemplary portable seating cushion in accordance with one embodiment of the invention.

The inventor has conceived, and reduced to practice, a portable seating cushion apparatus for improving blood flow by reducing point-pressure that may otherwise be applied to nerves and blood vessels in a user's leg, including the sciatic nerve, and improving posture by creating a forward pelvic tilt, which causes the rest of the user's shoulders, spine, back, and neck to come into alignment.

The invention is described by reference to various elements herein. It should be noted, however, that although the various elements of the inventive apparatus are described separately below, the elements need not necessarily be separate. The various embodiments may be interconnected and may be cut out of a singular block or mold. The variety of different ways of forming an inventive apparatus, in accordance with the disclosure herein, may be varied without departing from the scope of the invention.

Generally, one or more different embodiments may be described in the present application. Further, for one or more of the embodiments described herein, numerous alternative arrangements may be described; it should be appreciated that these are presented for illustrative purposes only and are not limiting of the embodiments contained herein or the claims presented herein in any way. One or more of the arrangements may be widely applicable to numerous embodiments, as may be readily apparent from the disclosure. In general, arrangements are described in sufficient detail to enable those skilled in the art to practice one or more of the embodiments, and it should be appreciated that other arrangements may be utilized and that structural changes may be made without departing from the scope of the embodiments. Particular features of one or more of the embodiments described herein may be described with reference to one or more particular embodiments or figures that form a part of the present disclosure, and in which are shown, by way of illustration, specific arrangements of one or more of the aspects. It should be appreciated, however, that such features are not limited to usage in the one or more particular embodiments or figures with reference to which they are described. The present disclosure is neither a literal description of all arrangements of one or more of the embodiments nor a listing of features of one or more of the embodiments that must be present in all arrangements.

Headings of sections provided in this patent application and the title of this patent application are for convenience only and are not to be taken as limiting the disclosure in any way.

Devices and parts that are connected to each other need not be in continuous connection with each other, unless expressly specified otherwise. In addition, devices and parts that are connected with each other may be connected directly or indirectly through one or more connection means or intermediaries.

A description of an aspect with several components in connection with each other does not imply that all such components are required. To the contrary, a variety of optional components may be described to illustrate a wide variety of possible embodiments and in order to more fully illustrate one or more embodiments. Similarly, although process steps, method steps, or the like may be described in a sequential order, such processes and methods may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the embodiments, and does not imply that the illustrated process is preferred. Also, steps are generally described once per aspect, but this does not mean they must occur once, or that they may only occur once each time a process, or method is carried out or executed. Some steps may be omitted in some embodiments or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Alternate implementations are included within the scope of various embodiments in which, for example, functions may be executed out of order from that shown or discussed, including substantially concurrently or in reverse order, depending on the functionality involved, as would be understood by those having ordinary skill in the art.

The apparatus disclosed herein is a portable seating cushion. The inventive apparatus improves blood flow by reducing point pressure that cuts-off or otherwise reduce blood circulation in the legs of a user's nerves and blood vessels, including the sciatic nerve. The inventive apparatus also improves posture by creating a forward pelvic tilt, which causes the rest of the user's shoulders, spine, back, and neck to come into alignment. More generally, the inventive apparatus maintains a slightly elevated angle while still maintaining structural support to keep the user's spine aligned.

FIG. 1 illustrates an exemplary embodiment of the inventive cushion 100. Specifically, FIG. 1 illustrates a user sitting on the portable seating cushion in a lotus position. Many of the figures herein illustrate a user sitting on the inventive apparatus in a lotus position. However, a user may sit on the cushion in a variety of different positions without departing from the scope of the invention. For example, the cushion may be placed on a chair, or a bench, and the user may, sit on the cushion as one normally may sit on a chair with feet on the floor. Generally, the benefits and features described below are applicable even if a user sits on the cushion in a variety of different positions and regardless of the surface that the cushion is placed upon.

Figure 6:
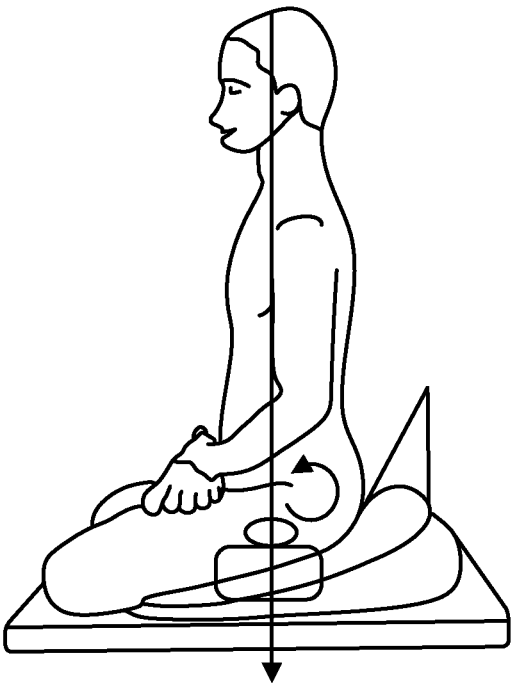
FIG. 6 illustrates a user sitting on one embodiment of the exemplary portable seating cushion.

Generally, and as described in greater detail below, and as illustrated in FIG. 1, the inventive apparatus provides a gradually inclined sitting surface. The gradually inclined surface promotes a forward pelvic tilt, which causes the hip flexors to open. FIG. 6 illustrates the spinal alignment that is encouraged by the apparatus disclosed herein. The forward pelvic tilt, as illustrated in FIG. 6, promotes proper posture by causing the spine, the back, the shoulder, the neck, and the head to be in proper alignment. Indeed, the inventive apparatus 100 promotes an ergonomic "S" curve of the spine. Moreover, the gradual incline of the sitting surface offers stability and support while tilting the hip flexors into the right position to decrease discomfort and promote proper circulation.

Furthermore, as described in greater detail below, and as illustrated in FIG. 1, the inventive apparatus provides tapered support to a user's upper legs and thighs when the user sits on the cushion. This eliminates or reduces point pressure that may be applied to a portion of the user's legs and/or thighs by prior art sitting devices that abruptly end at or near the user's buttocks. In one embodiment of the invention, the tapered support for a user's upper legs may be achieved by leg extension elements. The leg supports extension element support a substantial portion of the user's upper leg, thereby distributing the weight of the user's body throughout the upper leg. This feature improves circulation by, for example, reducing point-pressure or pinch-pressure at one or more specific points in the nerves or blood vessels that may otherwise be applied to one or two specific portions of the user's sciatic nerve.

In another aspect of the invention, as described in greater detail below, at least a portion of the inventive apparatus 100 is made from materials that compress and materials that do not compress significantly but shift or disperse slightly under a user's weight. The combination of these two materials, as disclosed herein, provides a gradually inclined sitting surface. Moreover, the combination of these two materials also provides a comfortable sitting surface for the user that is contoured to the user.

The inventive apparatus 100 can be used for a variety of other things. For example, it can be used as a nursing pillow so that caregivers have continuous support for babies during feedings. It may be used as a pillow that children use to sit comfortably on the floor. It may also be used as a supportive neck pillow while reading or playing. The inventive apparatus 100 may also be used as a portable pillow that can be used on office chairs, at sporting events, at parks, on camping trips, during air or ground travel, etc. The inventive apparatus 100 may also be used as a seating cushion that is fitted for chairs of varying sizes and shapes, benches, airplane seats and the like.

In one embodiment, as illustrated in the various figures provided herein, the inventive apparatus is comprised of an exterior enclosure 106, a foam element 104, a dispersion bag 102, which may be further comprised of dispersal elements 103. In one embodiment, the foam element 104 and dispersal bag 102 may be connected by a connection element 108.

Figure 3:
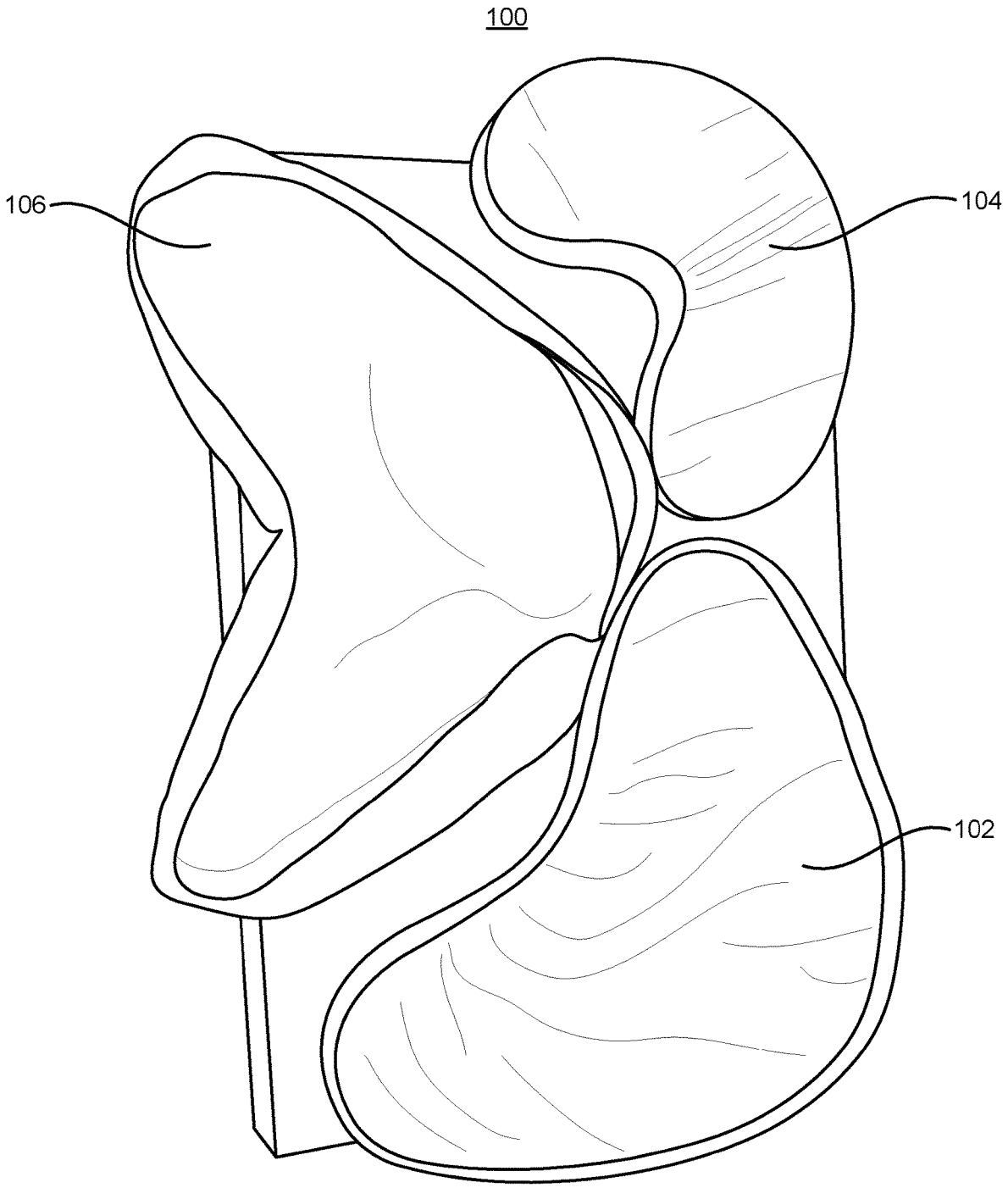
FIG. 3 illustrates, in accordance with one embodiment of the invention, the interior portions of the exemplary portable seating cushion.

FIG. 3 illustrates sub-elements of the inventive apparatus in accordance with an embodiment of the invention, including the foam element 104. The foam element 104 forms a portion of a sitting surface for a user. Generally, the foam element 104 is a supportive and cushioning piece of purposefully shaped foam that provides comfort to the tailbone called the Coccyx and sit bones called Ischial Tuberosities in the buttocks. In one embodiment of the invention, the foam element 104 may compress more than the dispersion elements 103. In this manner, the two elements 104 and 103 together provide a comfortable sitting surface for the user that is both supportive and contouring, but also firm enough to ensure a forward and slightly angled pelvic tilt.

The foam element 104 may be comprised of compressible foam in one exemplary embodiment of the invention. It should be noted, however, other material with the same or similar resistance to compression may be used without departing from the scope of the invention, including, for example, cotton batting inside a fabric sleeve, foam/cotton batting combination, etc.

Figure 5A:
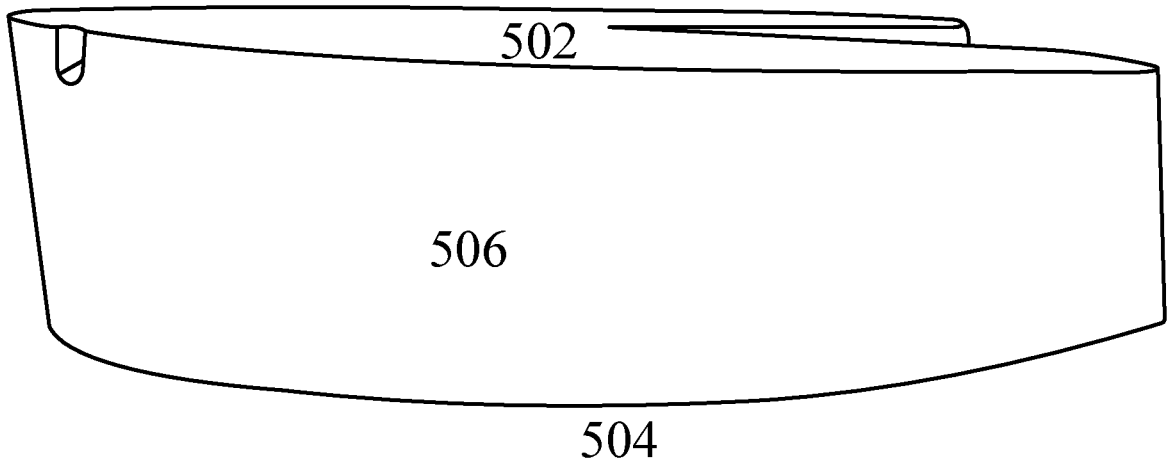
FIG. 5A illustrates a side view of one embodiment of the interior apparatus in accordance with the exemplary portable seating cushion.

FIG. 5A illustrates, from a side perspective, one exemplary embodiment of the foam element 104. As illustrated in FIG. 5A, the foam element 104 may be gradually inclined. In one embodiment, the foam element 104 is comprised of a gradually inclined first surface 502 and a substantially planar second surface 504, the first and second surfaces define therebetween a volume 506 of gradually changing thickness. The specific angle of incline of the first surface 502 may vary, as would be understood by a person of ordinary skill in the art, without departing from the scope of the invention. For example, the angle of incline of the first surface 502 may be one degree to accommodate certain user types, and can range up to 40 degrees to accommodate other users types.

In one embodiment of the invention, the foam element 502 may be further comprised of extension elements that extend to support a user's upper legs and thighs. In one embodiment, the extension elements may give the cushion an approximately crescent shape.

Referring again to FIG. 3, it also illustrates the dispersing bag 102 in accordance with an embodiment of the invention. In this particular illustration, the dispersing bag 102 encloses dispersion elements within the interior cavity of the dispersion bag 102. In one embodiment, the amount of dispersing element that is placed or filled inside the dispersion bag 102 is limited to ensure that the dispersing element can move around slightly within the connection element or interior space when pressure is applied to the apparatus 100, for example, when a user sits on the apparatus 100. The movement of the dispersing element 102 improve the comfort associated with the device by creating a slightly contoured sitting surface for the user. In one embodiment, the dispersion bag 102 is made of a fabric or a cloth-like material, which enables the bag to take the shape- and vary its shape-based on the movement and arrangement of dispersion elements that are placed within the bag's 102 interior cavity.

It is an object of the invention to use a dispersing element that compresses slightly when a user sits on the apparatus 100 and which has greater resistance to compressive forces than the foam element, while still maintaining comfort and cushioning and which maintains a slightly angled pelvic lift. If the apparatus 100 is used for other purposes, then the dispersing element 102 may be selected such that it compresses only slightly when the intended weight is placed upon the apparatus 100. The limited compression ensures that the user experiences "pelvic lift" (i.e. that his or her pelvis has a straight or a forward orientation). This feature of the invention promotes better posture by aligning the user's back, spine, back, shoulders, neck, and head and promoting an "S" curve in the user's spine.

Any number of dispersing elements may be used without departing from the scope of the invention. In a preferred embodiment of the invention, buckwheat hulls are used as dispersing elements. Buckwheat hulls are preferred because they are recyclable and sustainable. Moreover, they do not conduct heat, and tend not to compress under pressure/weight. In addition, in accordance with one embodiment of the invention, the buckwheat hulls are lightly packed within the connection element allowing for some space for them to move around under pressure/weight. In such an embodiment, the movement of the buckwheat hulls give the user a feeling of being slightly contoured. Other types of materials may be used without departing from the scope of the invention, including, but not limited to Styrofoam, beads, sand, grain, buckwheat hull/Styrofoam bead blend, etc.

In one embodiment of the invention, the dispersion bag 102 is further comprised of two leg support extension elements. The leg support extension elements support the user's legs by preventing pinching or the application of point-pressure on blood vessels and/or nerves on the user's legs.

Figure 4A:
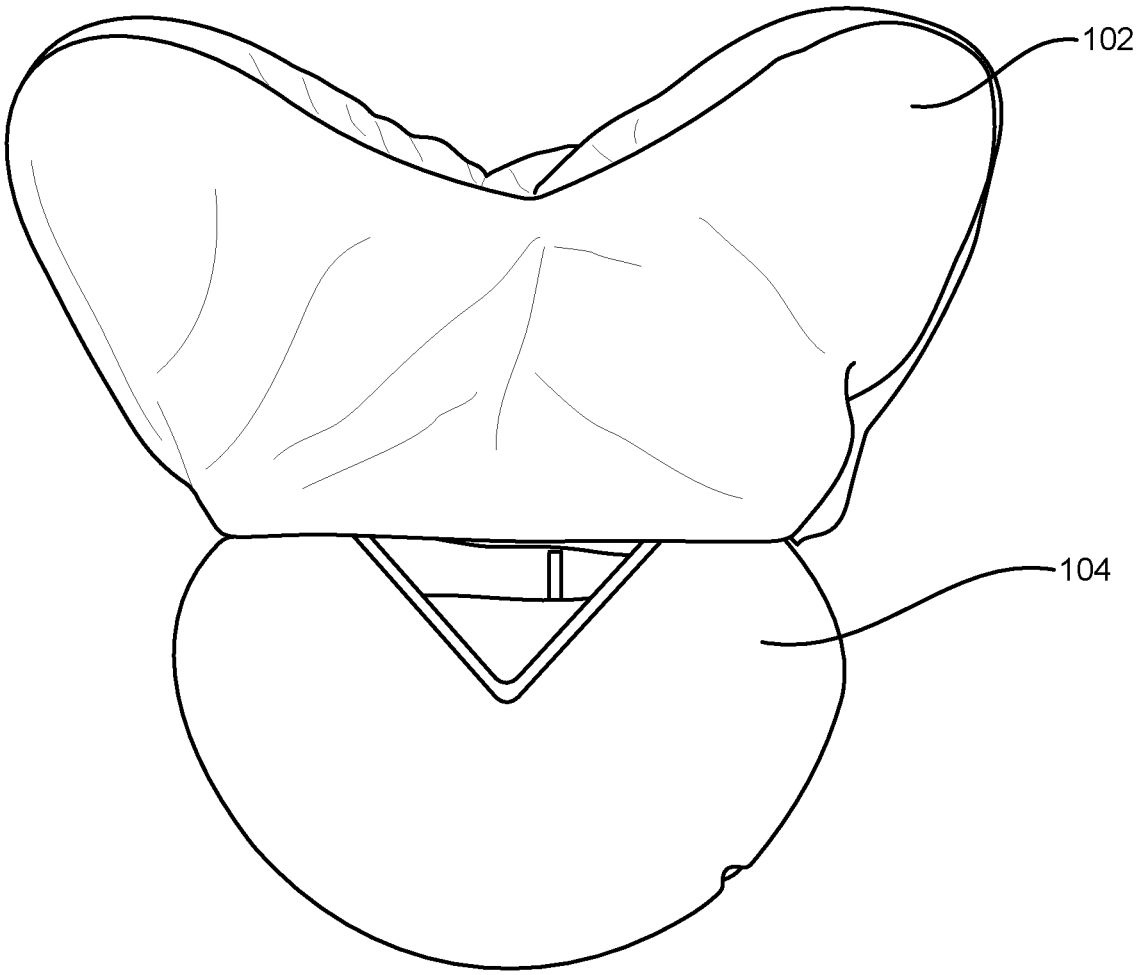
FIG. 4A illustrates exemplary interior apparatuses in accordance with one embodiment of the exemplary portable seating cushion.
Figure 4B:
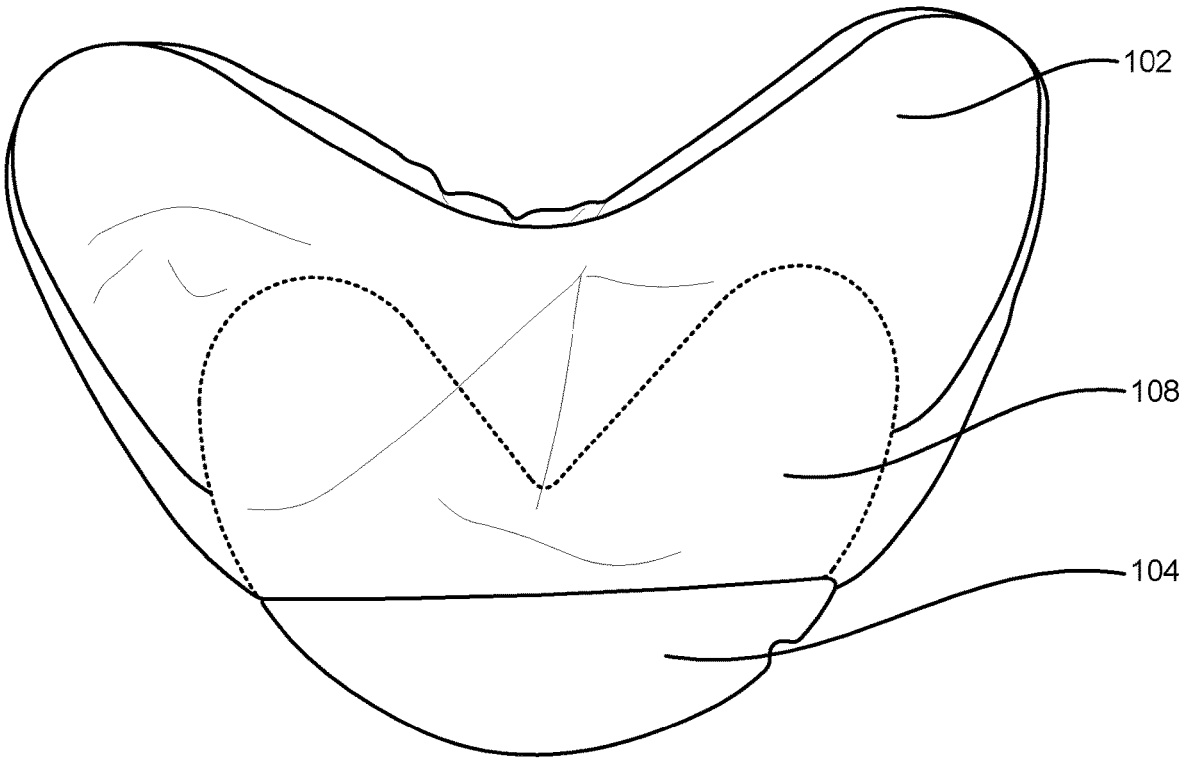
FIG. 4B illustrates one embodiment of the interior apparatuses in accordance with the exemplary portable seating cushion.

FIG. 4A and FIG. 4B illustrate a connection element 108 for connecting the foam element 104 with the dispersion element 102. In one embodiment of the invention, the connection element holds the dispersing element 102 and secures the foam element 104 in place. The connection element serves to keep the internal elements together, so they can retain their shape and remain functional for use. Because of this, the connection element also provides an additional layer of support. For example, the connection element 108 provides additional stability which prevents the various elements of the invention from moving about.

In one embodiment, as illustrated in FIGS. 4A and 4B, the connection element 108 is implemented as a liner. The liner encloses the dispersing element in a dispersion bag 102 and includes reception portions for the leg support extension elements of the foam element 104.

In one embodiment, the connection element 108 is made of impermeable material that prevents the dispersion elements from exiting the dispersion bag 102.

However, the invention disclosed herein is not limited to any particular method of connecting the foam element 104 to the dispersion elements 102. Any number of alternate ways of connecting the dispersion element 102 and foam element 104 may be used, as would be readily apparent to a person of ordinary skill in the art, without departing from the scope of the invention, including enclosing the dispersion element 102 and the foam element 104 in separate liners and connecting the liners together. In one embodiment, the foam element 104 and the dispersion bag 102 may separately connect to specific portions of the interior cavity of the exterior enclosure to ensure that the two elements work together to provide a comfortable seating position for a user. The two elements 102 and 104 may also be connective without a liner, via a variety of connection mechanism including hook and loop closure systems, magnets, zippers, sewn portions, buttons or metal snaps, etc.

Figure 5B:
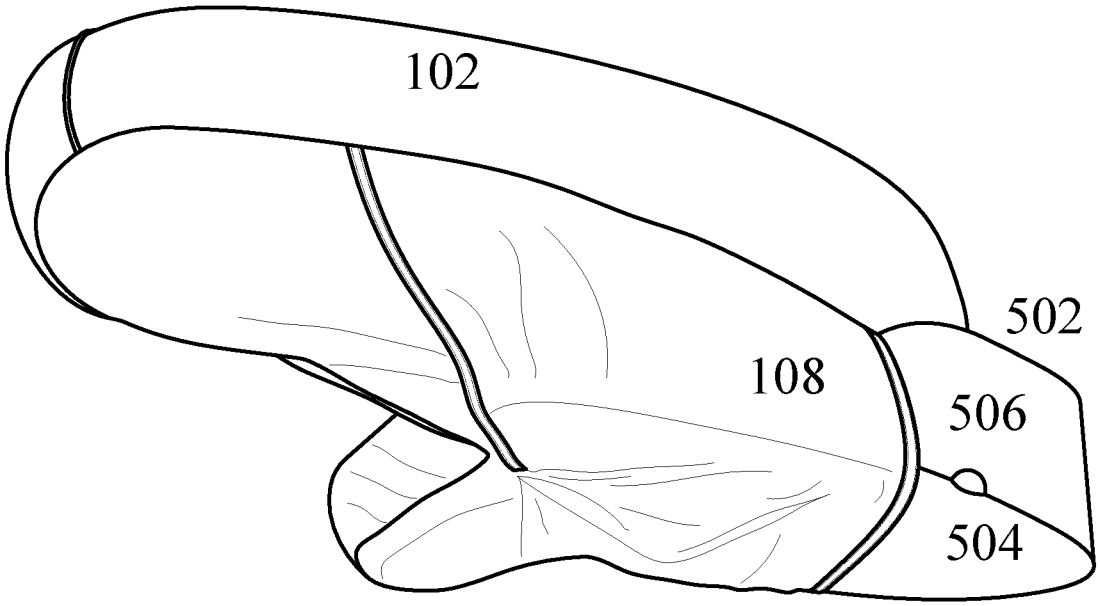
FIG. 5B illustrates a side view of the interior apparatuses in accordance with one embodiment of the exemplary portable seating cushion.

FIG. 5B illustrates an exemplary gradually inclined sitting surface of the apparatus 100. Specifically, FIG. 5B does not sufficiently illustrate the gradually inclined sitting surface that is formed by a combination of the foam element 104 and dispersion element 102. However, this is done to illustrate other portions of the apparatus and provide appropriate context. In accordance with the preferred embodiment of the invention, the foam element 104 is placed below the dispersion bag 102. For example, the planar surface 504 of the foam element 104 is typically placed on a surface such as a chair or the ground. The dispersion bag 102 is placed over the gradually inclined surface 502 of the foam element 104. As such, the sitting surface formed by the cushion element 104 and the dispersion bag 102 also has a gradual incline, that is imparted, in part by the gradual incline of the cushion element and in part by the incline formed by placing the back portion of the dispersion bag 102 over the cushion and the front portion of the dispersion bag 102 on the underlying surface. In one exemplary embodiment, the apparatus 100 (or a combination of the dispersion element 102 and the foam element 104) has a 3-4% slope. However, other incline angles may be achieved without departing from the scope of the invention, as would be readily apparent to a person of ordinary skill in the art. This slope ensures that a user's pelvic tilt is in a forward or a straight direction, thereby opening the hip flexors, and improving the "S" curve of the spine.

The incline of the sitting surface may be altered by using a variety of different techniques, which would be familiar to a person of ordinary skill in the art. For example, the slope may be varied by varying the amount of fill or dispersion elements that are paced in the dispersion bag 102. The slope may also be varied by using different types of material in the dispersion element and the cushion element 104. The slope may also be varied by altering the slope of the sitting surface 502, etc.

One aspect of the inventive apparatus 100 disclosed herein is that the tilt imparted to the user's hip flexors may be altered slightly by a user. For example, a user may be able to direct the dispersion elements 102 towards one side of the apparatus 100 or another, thereby either increasing or decreasing the slope of the apparatus without making other significant changes to it. Similarly, a user may adjust the tilt by imparted to his or her hip flexors by sitting closer to the back portion of the apparatus 100 or towards the extension elements 202A and 202B.

Figure 2A:
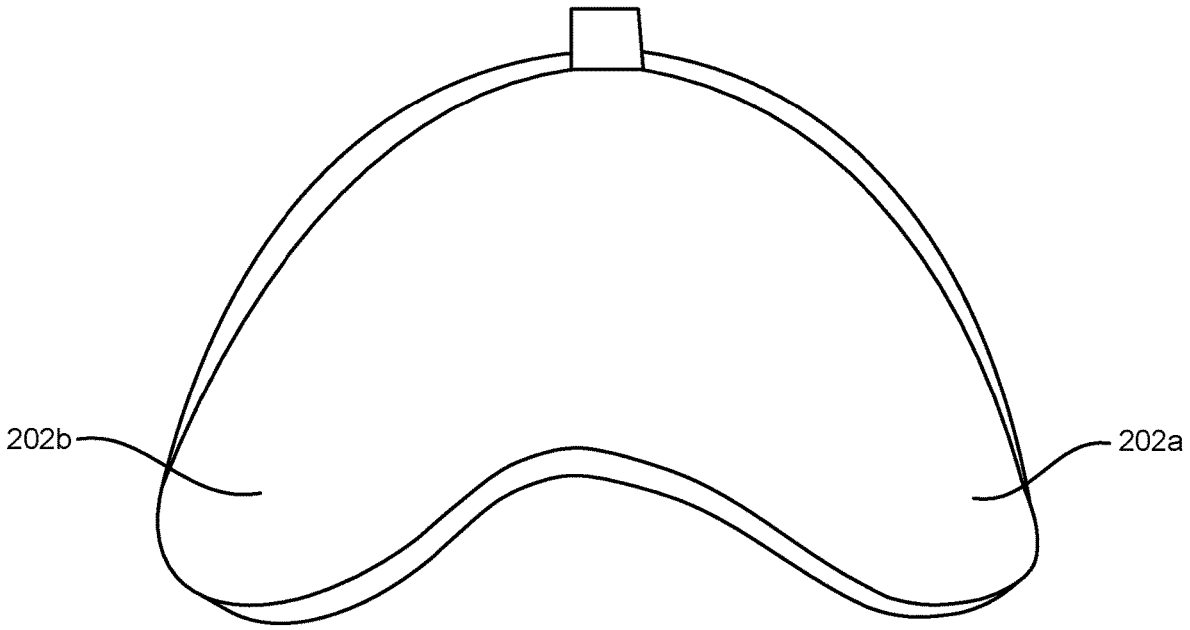
FIG. 2A illustrates an exemplary portable seating cushion from a top view in accordance with one embodiment of the invention.
Figure 2B:
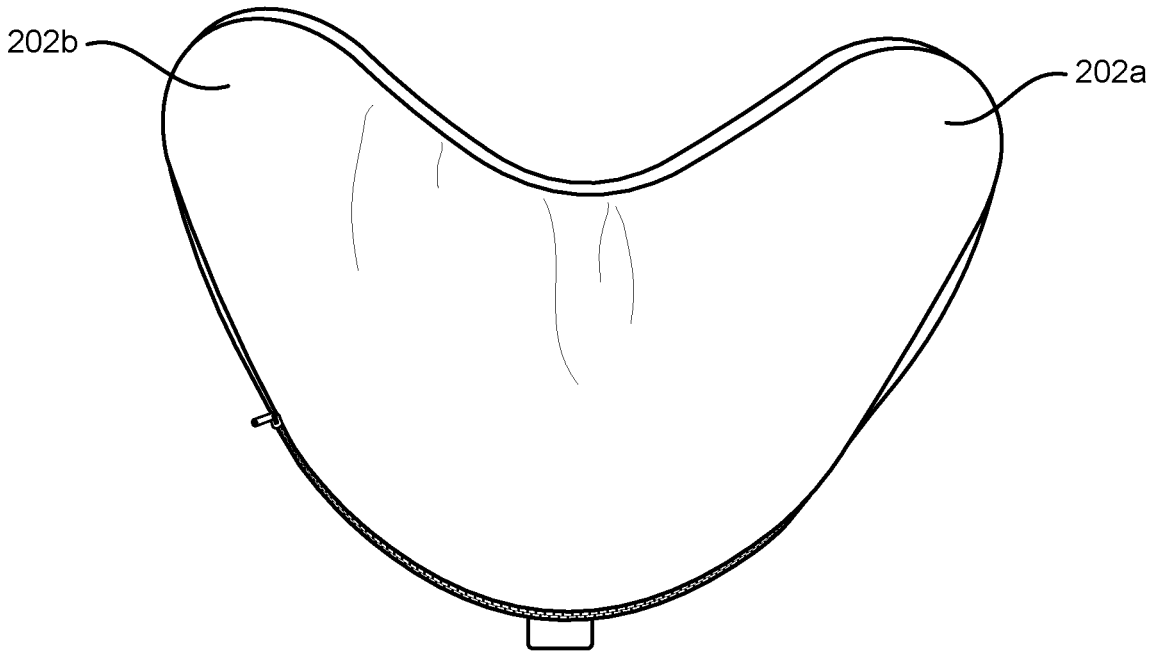
FIG. 2B illustrates an exemplary portable seating cushion from a bottom view in accordance with one embodiment of the invention.

FIG. 2A and FIG. 2B illustrate leg support extension elements 202A and 202B in accordance with one exemplary embodiment of the invention. The leg support extension elements 202A and 202B extend from the inventive apparatus 100. In one exemplary embodiment, the leg support extension elements 202A and 202B extend outward is a partially curved shape, thereby forming a crescent shape with the apparatus 100. But generally, the leg support extension elements 202A and 202B extend in a direction that is generally parallel with the sciatic nerve when a user is sitting on the apparatus 100.

The leg support extension elements 202A and 202B support a substantial portion of the user's upper leg, including the user's thighs. By doing so, the leg support extension elements 202A and 202B avoid compressing a user's sciatic nerve along any one or more particular portions of the nerve. In other words, the leg support extension elements 202A and 202B distribute the pressure that is placed on a user's sciatic nerve along the entire surface of elements 202A and 202B. This redistribution improves blood circulation. In addition, the leg support extension elements 202A and 202B eliminate the outer ridge that is typically placed around prior art meditation cushions. As such, the leg support extension elements 202A and 202B reduce the constriction of blood vessels in a user's upper leg by getting rid of the ridge at the edge of the cushion that increases pressure on the sciatic nerve (e.g., while seated in the lotus position or while seated in an office chair).

In one embodiment of the invention, the leg support elements 202A and 202B are gradually inclined to gently distribute the user's weight across the entire portion of the user's leg that is in contact with the apparatus 100.

In one embodiment, the leg support extension elements 202A and 202B may be comprised of extension portions of the dispersion bag 102 and/or extension portions of the foam element 104.

The leg support extension elements 202A and 202B, as illustrated in the various figures herein, are exemplary and not intended to be limiting. The elements may be varied in size, length, curvature, and incline without departing from the scope of the invention.

Figure 2C:
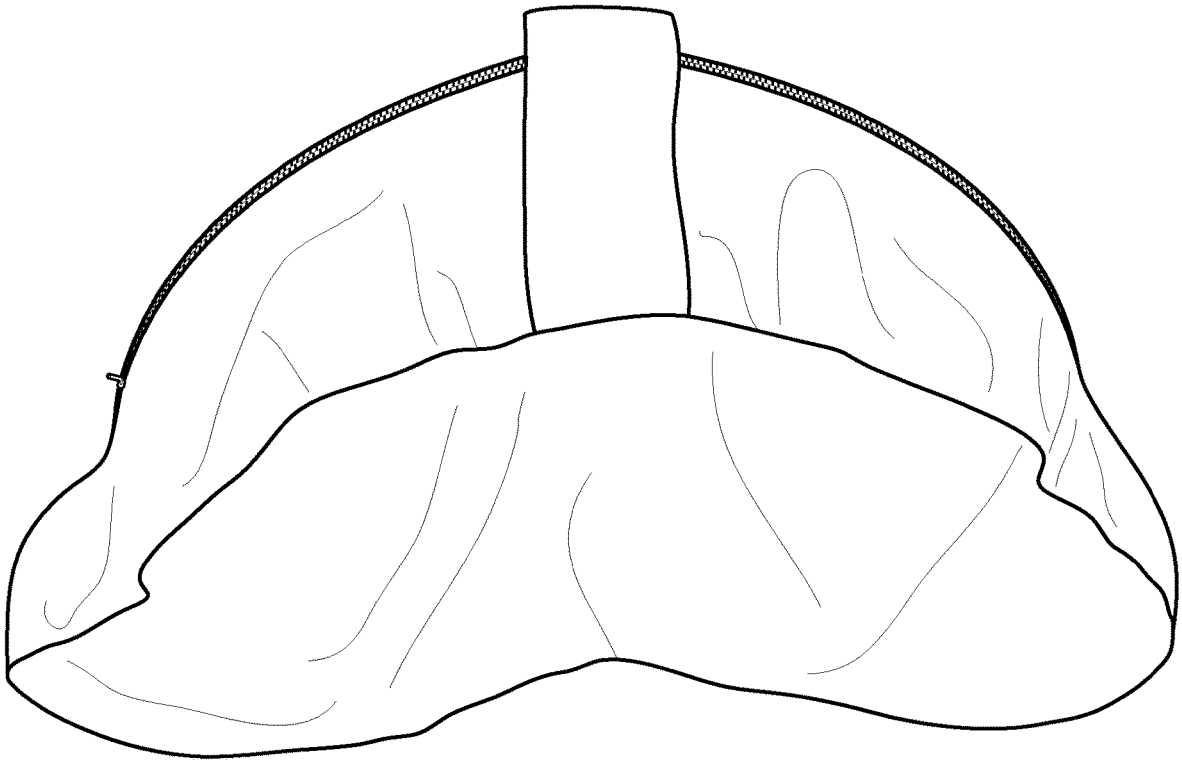
FIG. 2C illustrates an exemplary portable seating cushion from a side view in accordance with one embodiment of the invention.

FIGS. 2A, 2B, and 2C illustrate the exterior enclosure 106 of the inventive apparatus 100 in accordance with one embodiment of the invention. In one exemplary embodiment, the exterior enclosure is made of durable fabric. In one exemplary embodiment, the exterior enclosure is removable and washable. In one embodiment, the exterior enclosure may include a closure mechanism for easy removal of the connection element 108. The exterior enclosure may also include a handle, which may aid a user in carrying the apparatus 100.

Specifically, the exterior enclosure encloses the dispersion bag 102 and the foam element 104 within the interior cavity of the exterior enclosure. The exterior enclosure includes a sitting surface and a bottom surface, wherein the dispersion bag is above the foam element when the sitting surface of the exterior enclosure is above the bottom surface. Additionally, the gradually inclined first surface of the foam element is substantially parallel to the sitting surface of the exterior enclosure and the substantially planar surface of the foam element is substantially parallel to the bottom surface of the exterior enclosure. The sitting surface has a gradual incline that is caused at least in part by the gradually inclined first surface of the foam element 104 and the enclosed dispersion bag 102 that partially conforms to the shape of the foam element.

In one embodiment of the invention, the exterior enclosure provides an additional layer of support. For example, the exterior enclosure is constructed to accommodate the interior elements very snugly. This creates an additional layer of support. Moreover, the exterior enclosure has significant structural integrity (i.e. it is not made out of material that has significant stretch or flexibility). As a result, the exterior enclosure provides additional structure to the apparatus and ensures that the apparatus continues to provide a forward pelvic tilt and ensuring that the interior elements do not separate within the exterior enclosure. Thus providing a stable sitting surface for a user when the interior elements are compressed.

Any material may be used to create an exterior enclosure, as would be apparent to a person of ordinary skill in the art, including, but not limited to linen, cotton, silk, neoprene, blended fabrics, other water resistant materials, etc. Additionally, the exterior enclosure may include a non-slip surface, including, but not limited to, non-slip rubber, gripper fabric, non-slip tape, hook-and-loop closure mechanism, etc.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled." however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive "or" and not to an exclusive "or". For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs for a system and a process for creating an interactive message through the disclosed principles herein. Thus, while particular embodiments and applications have been illustrated and described, it is to be understood that the disclosed embodiments are not limited to the precise construction and components disclosed herein. Various apparent modifications, changes and variations may be made in the arrangement, operation and details of the method and apparatus disclosed herein without departing from the spirit and scope defined in the appended claims

What is claimed is:

1. A portable seating cushion comprising:

a foam element having a gradually inclined first surface and a substantially planar second surface, the first and second surfaces defining therebetween a volume of gradually changing thickness, wherein a back portion of the foam element is thicker than a front portion of the foam element and the first surface gradually inclines from the front portion to the back portion;

a dispersion bag enclosing dispersion elements within an interior cavity of the dispersion bag, the dispersion elements providing greater resistance to compressive forces than the foam element;

an exterior enclosure enclosing the dispersion bag and the foam element within the interior cavity of the exterior enclosure, the exterior enclosure having a sitting surface and a bottom surface, wherein the dispersion bag is placed above the foam element when the sitting surface of the exterior enclosure is above the bottom surface, and wherein the combination of the foam element and the dispersion bag impart a gradually inclined sitting surface; and wherein a back portion of the dispersion bag is positioned over the foam element, and a front portion of the dispersion bag is adjacent to the bottom surface of the exterior enclosure so that the dispersion bag partially conforms to the foam element.

2. The portable seating cushion of claim 1, further comprising two leg support extension elements extending from a portion of the portable seating cushion, the leg support extension elements being configured to support the upper thighs of a user sitting on the portable seating cushion.

3. The portable seating cushion of claim 2, wherein the two leg support extension elements are tapered to minimize the amount of point pressure that is applied by the portable seating cushion to the upper thighs of a user sitting on the portable seating cushion.

4. The portable seating cushion of claim 2, wherein the foam element is further comprised of two leg support extension foam elements, the leg support extension foam elements each having a gradually inclined first surface and a substantially planar second surface.

5. The portable seating cushion of claim 2, wherein the dispersion bag is further comprised of two leg support extension elements.

6. The portable seating cushion of claim 1, wherein the foam element compresses more than the dispersion elements under the weight of a user.

7. The portable seating cushion of claim 1, wherein the dispersion elements are configured to move about within the interior cavity of the dispersion bag.

8. The portable seating cushion of claim 6, wherein the movement of the dispersion elements that is caused by the weight of a user creates a contoured sitting surface for the user.

9. The portable seating cushion of claim 1, wherein the dispersion elements are comprised of buckwheat hulls.

10. The portable seating cushion of claim 1, wherein the dispersion elements conduct less heat than the foam element.

11. The portable seating cushion of claim 1, further comprising a connection element for connecting the foam element to the dispersion bag.

12. The portable seating cushion of claim 11, wherein the dispersion bag connected to the foam element form the gradually inclined sitting surface.

13. The portable seating cushion of claim 1, wherein the gradually inclined sitting surface of the exterior enclosure provides pelvic lift to a user who sits on the portable seating cushion.

14. The portable seating cushion of claim 1, wherein the gradually inclined sitting surface of the exterior enclosure promotes spinal alignment of the spine of a user who sits on the portable seating cushion.

* * * * *